US011225786B2

(12) United States Patent
Yu et al.

(10) Patent No.: US 11,225,786 B2
(45) Date of Patent: Jan. 18, 2022

(54) DRY PROCESS CONNECTED ENERGY-CONSUMING BEAM COLUMN JOINT BASED ON CORBEL

(71) Applicant: Southwest Jiaotong University, Chengdu (CN)

(72) Inventors: Zhixiang Yu, Chengdu (CN); Yuntao Jin, Chengdu (CN); Chun Liu, Chengdu (CN); Liping Guo, Chengdu (CN); Liru Luo, Chengdu (CN); Wenjun Gao, Chengdu (CN); Hu Xu, Chengdu (CN); Lei Zhao, Chengdu (CN); Rui Guo, Chengdu (CN)

(73) Assignee: Southwest Jiaotong University, Chengdu (CN)

( * ) Notice: Subject to any disclaimer, the term of this patent is extended or adjusted under 35 U.S.C. 154(b) by 0 days.

(21) Appl. No.: 17/030,396

(22) Filed: Sep. 24, 2020

(65) Prior Publication Data

US 2021/0214931 A1 Jul. 15, 2021

(30) Foreign Application Priority Data

Jan. 14, 2020 (CN) ..... 202010035850.0

(51) Int. Cl.
*E04B 1/00* (2006.01)
*E04B 1/21* (2006.01)
(Continued)

(52) U.S. Cl.
CPC ..... *E04B 1/215* (2013.01); *E04B 1/40* (2013.01); *E04C 3/20* (2013.01); *E04C 3/34* (2013.01)

(58) Field of Classification Search
None
See application file for complete search history.

(56) References Cited

U.S. PATENT DOCUMENTS 3,435,580 A * 4/1969 Johnson ..... E04B 2/58 52/405.3
5,634,308 A * 6/1997 Doolan ..... E01D 2/00 14/73

(Continued)

FOREIGN PATENT DOCUMENTS

CN 204753814 U 11/2015
CN 109457801 A 3/2019

OTHER PUBLICATIONS

Hai-Tao Wan et al., Analysis of deformation limits for reinforced concrete beam, Journal of Shenyang University of Technology, Dec. 2011, pp. 715-720, vol. 33, No. 6.

*Primary Examiner* — Basil S Katcheves
(74) *Attorney, Agent, or Firm* — Bayramoglu Law Offices LLC

(57) ABSTRACT

A dry process connected energy-consuming beam column joint based on a corbel includes a prefabricated concrete corbel column, pre-buried steel plates and connecting steel plates, wherein the corbel section of the prefabricated concrete corbel column is stepped, and a notch section of a prefabricated concrete notch beam is matched with the stepped section of the corbel and is in lap joint to the stepped section; the pre-buried steel plates are separately pre-buried on the upper and lower surfaces of the corbel and the prefabricated concrete notch beam, friction plates are arranged outside the pre-buried steel plates, and slight tooth spaces are arranged on the sides, facing the pre-buried steel plates, of the friction plates; and the connecting steel plates are arranged on the left and right sides of the prefabricated concrete notch beam and the corbel lap joint section.

5 Claims, 5 Drawing Sheets

(51) Int. Cl.

| | |
|---|---|
| ***E04B 1/41*** | (2006.01) |
| ***E04C 3/20*** | (2006.01) |
| ***E04C 3/34*** | (2006.01) |

(56) References Cited

U.S. PATENT DOCUMENTS

| | | | | |
|---|---|---|---|---|
| 9,765,521 | B1 * | 9/2017 | Abbas | E04B 1/22 |
| 2002/0062616 | A1 * | 5/2002 | Ocampo | E04B 1/215 52/656.9 |
| 2008/0060293 | A1 * | 3/2008 | Hanlon | E04B 5/04 52/251 |
| 2008/0072511 | A1 * | 3/2008 | Phuly | E04G 21/02 52/294 |
| 2009/0188201 | A1 * | 7/2009 | Ghali | E04C 5/167 52/719 |
| 2011/0061321 | A1 * | 3/2011 | Phuly | E02D 27/425 52/297 |

* cited by examiner

DRY PROCESS CONNECTED ENERGY-CONSUMING BEAM COLUMN JOINT BASED ON CORBEL

CROSS REFERENCE TO THE RELATED APPLICATIONS

This application is based upon and claims priority to Chinese Patent Application No. 202010035850.0, filed on Jan. 14, 2020, the entire contents of which are incorporated herein by reference.

TECHNICAL FIELD

The present invention relates to the technical field of building structure, and in particular to a dry process connected energy-consuming beam column joint structure.

BACKGROUND

With the constant progress of urbanization, continuous deepening of industrialization, as well as the continuous improvement of education level and the aggravation of population aging, the demographic dividend of China is gradually disappearing. The construction work trade with high labor intensity and poor working environment is gradually abandoned. Meanwhile, traditional construction enterprises face many noticeable problems, such as large amount of labor, large consumption of resources, low production efficiency, serious environmental pollution and waste of water resources, which directly restrict the development of traditional construction industry. In order to solve these problems, the building structure system based on prefabricated concrete has become known to the public, and has been promoted and applied as a key means of building industrialization.

Due to the characteristics of factory prefabrication, construction site hoisting and splicing of the prefabricated concrete structure, the splicing joints of members like beam, plate and column are the weak points. The connection mode and construction characteristics of the joints affect not only the overall mechanical behavior of the structure, but also the production efficiency. Therefore, the in-depth study on the connection mode of prefabricated concrete joints is of great significance to promote the building industrialization.

The prefabricated buildings started late in China, leaving many blank areas in basic research and lacking guidance in engineering practice. Due to the characteristics of prefabricated type, the connection mode and construction characteristics of the joints affect not only the overall mechanical behavior of the structure, but also the production efficiency. At present, wet connection is mainly used in China, but it affects the construction period and cannot give full play to the advantages of the prefabricated type. Dry connection is also used, but it is featured with complex structure and difficult installation, and the energy-consuming capacity is seriously insufficient.

SUMMARY

With regard to the above problems, the present invention aims to provide a dry process connected energy-consuming beam column joint that is featured by simple structure, convenient construction and can improve the production efficiency and effectively improve the energy-consuming capacity during earthquake. The technical solution is as follows:

A dry process connected energy-consuming beam column joint based on a corbel, comprising:

a prefabricated concrete corbel column, wherein the corbel section of the prefabricated concrete corbel column is stepped, and a notch section of a prefabricated concrete notch beam is matched with the stepped section of the corbel and is in lap joint to the stepped section;

pre-buried steel plates separately pre-buried on the upper and lower surfaces of the corbel and the prefabricated concrete notch beam, wherein friction plates are arranged outside the pre-buried steel plates, and slight tooth spaces are arranged on the sides, facing the pre-buried steel plates, of the friction plates;

connecting steel plates, wherein the connecting steel plates are arranged on the left and right sides of the prefabricated concrete notch beam and the corbel lap joint section;

high-strength bolts, wherein a vertical high-strength bolt runs through the friction plates and the pre-buried steel plates and fixes them on the corbel/the prefabricated concrete notch beam; a horizontal high-strength bolt runs through the corbel/the prefabricated concrete notch beam, and connects the connecting steel plates on both sides.

Furthermore, the upper and lower surfaces have two pre-buried steel plates respectively, which are arranged on the corbel and the prefabricated concrete notch beam.

Furthermore, the upper and lower surfaces have one friction plate respectively.

Furthermore, a certain gap a exists between the notch beam and the corbel column, so that there is enough stroke for the friction plate to consume energy under the action of earthquake; according to the geometrical relationship of joint rotation, gap a can be calculated as follows:

$$\Delta = a;$$

the calculation formula of shear deformation angle θ of members is as follows:

$$\theta = \frac{\Delta}{l};$$

Δ—displacement of the top of the member under the action of horizontal load;

l—clear height of the member;

and the following can be obtained through geometrical relationship: $a=\Delta=l\theta$.

On the other hand, the present application sets forth a construction method for the dry process connected energy-consuming beam column joint based on a corbel according to one of the forgoing claims, comprising the following steps:

a. determining the size of a friction plate, the thickness of a connecting steel plate, the quantity and diameter of high-strength bolts according to the design documents;

b. prefabricating a prefabricated concrete corbel column and a prefabricated concrete notch beam respectively, pre-burying a pre-buried steel plate, snapping an installation positioning line on the two members, indicating the direction, axis number and elevation, wherein the first-layer column shall be marked ±0.00 mm horizontal line;

c. hoisting the prefabricated concrete corbel column, correcting the plane position and verticality of the prefabricated concrete corbel column, and installing the prefabricated concrete corbel column after meeting the requirements;

d. hoisting the prefabricated concrete notch beam, and correcting the axis position and elevation of the prefabricated concrete notch beam;

e. applying the high-strength bolts to install the connecting steel plate, connecting the prefabricated concrete notch beam and the prefabricated concrete corbel column into a whole;

f. applying the high-strength bolts to install the friction plate.

Furthermore, step c also comprises:

hoisting the prefabricated concrete corbel columns in sequence along the longitudinal axis, wherein the hoisting speed should be slow during the hoisting process; suspending lifting after the lifting rope is tightened, and checking the reliability of the lifting point in time to prevent falling off, wherein in order to avoid swinging back and forth when hoisting in place, slip rope is tied at the lower part of the prefabricated concrete corbel column, and hoisting can be carried out after all parts are connected reliably and correctly.

Furthermore, step d also comprises:

hoisting the notch beam, checking the elevation and position of the corbel again before hoisting, suspending lifting after being about 500 mm above the ground in the hosting process, checking the hoisting appliance carefully and hosting in place after confirming it is correct, aligning the positioning line on the notch beam with the positioning line on the corbel, placing on the corbel column slowly, and making adjustment, wherein the operator holds stable from both ends, visually aligns the axis, and stably drops the hook, so that the notch beam can be seated stably.

The present invention is advantageous in the following aspects: overcoming the defect that it still needs to support a framework, cast concrete on site and cure the concrete in a construction site in a current wet process operation, improving construction efficiency, reducing formwork support and raising economic benefit; in addition, the present invention is superior to the prestressed connection mode and reduces the construction professionalism and accuracy, so that operation by professional personnel is not required. Meanwhile, the disadvantages of poor energy-consuming and insufficient seismic capacity of bolted joints have been overcome, so that it can be widely used in engineering practice.

BRIEF DESCRIPTION OF THE DRAWINGS

To describe embodiments of the present invention or the technical solution in the prior art clearer, hereinafter, drawings that are to be referred to for description of the embodiments or the prior art are briefly described. It is apparent that the drawings described hereinafter merely illustrate some embodiments of the present invention. A person of ordinary skill in the art may also derive other drawings based on the drawings described herein without any creative effort.

DETAILED DESCRIPTION OF THE EMBODIMENTS

Figure 1:
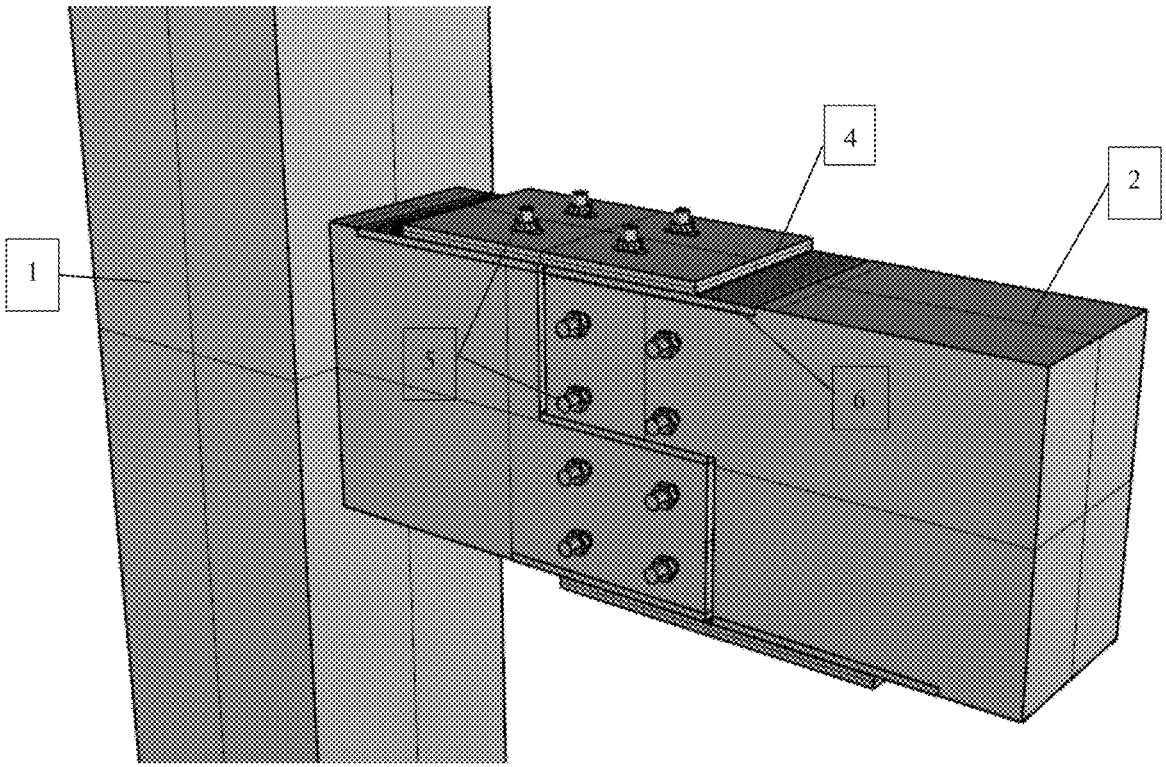
FIG. 1 is a structural diagram of a dry process connected energy-consuming beam column joint provided by an embodiment of the present application (connecting steel plate not shown).
Figure 2:
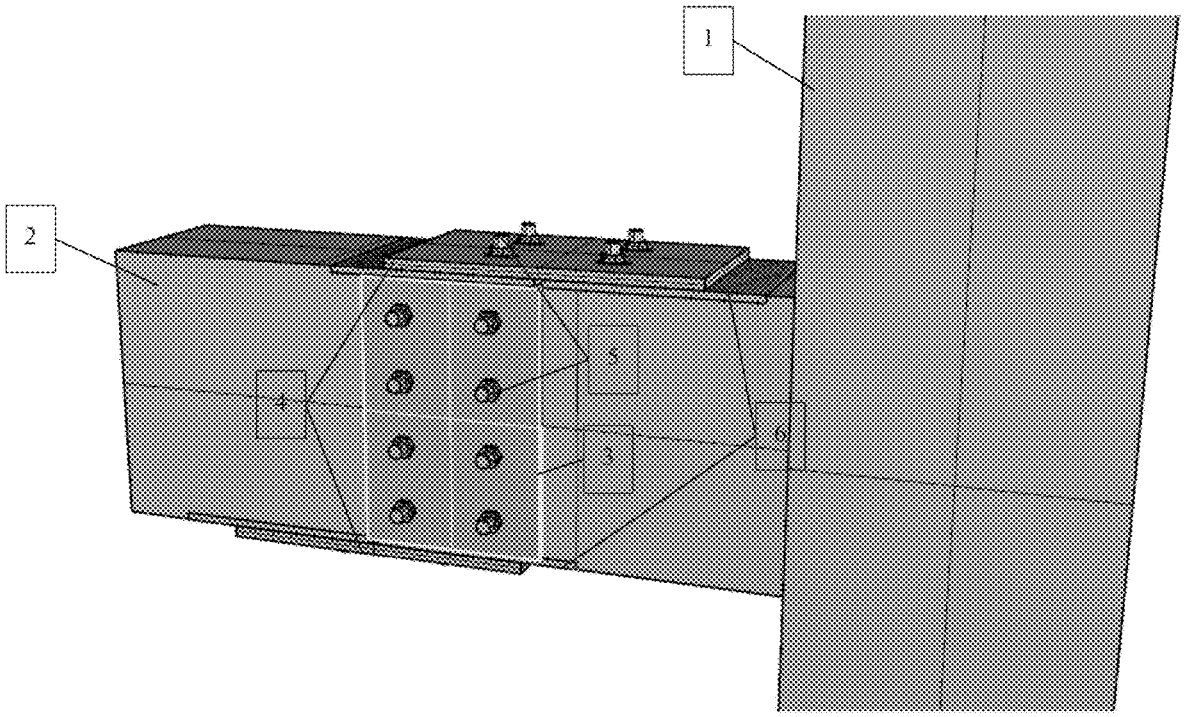
FIG. 2 is a structural diagram of a dry process connected energy-consuming beam column joint provided by an embodiment of the present application (connecting steel plate shown).
Figure 3:
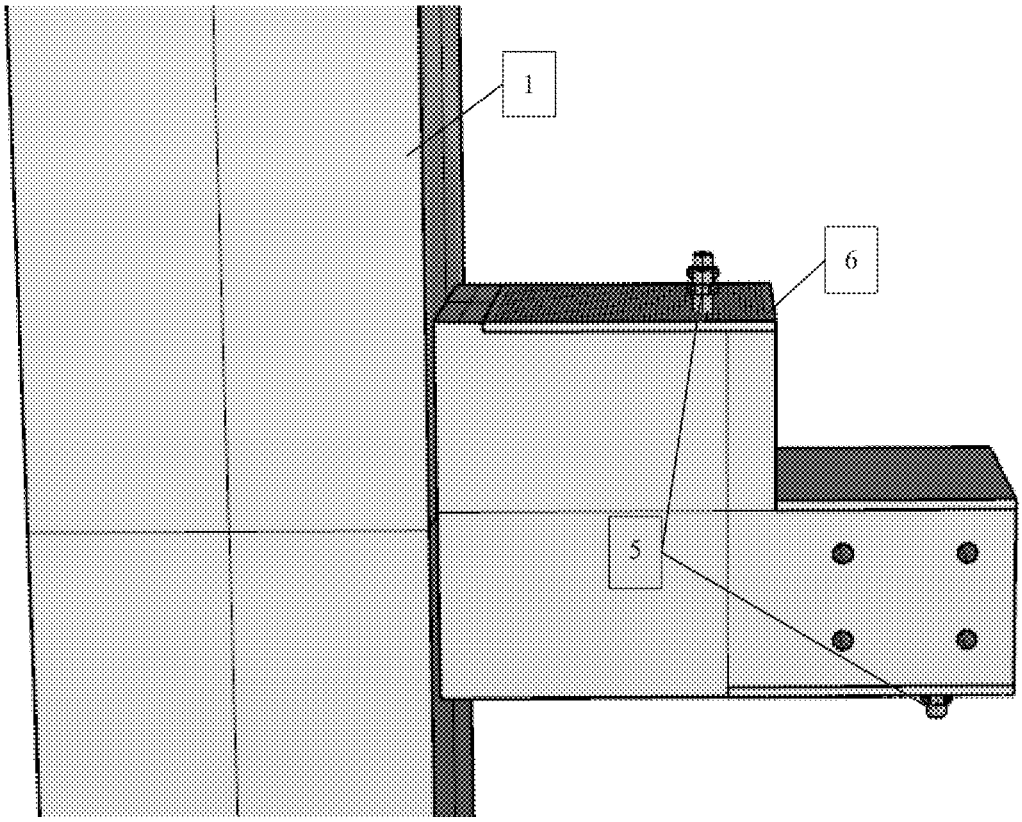
FIG. 3 is a stereogram of a prefabricated concrete corbel column of a dry process connected energy-consuming beam column joint provided by an embodiment of the present application.
Figure 4:
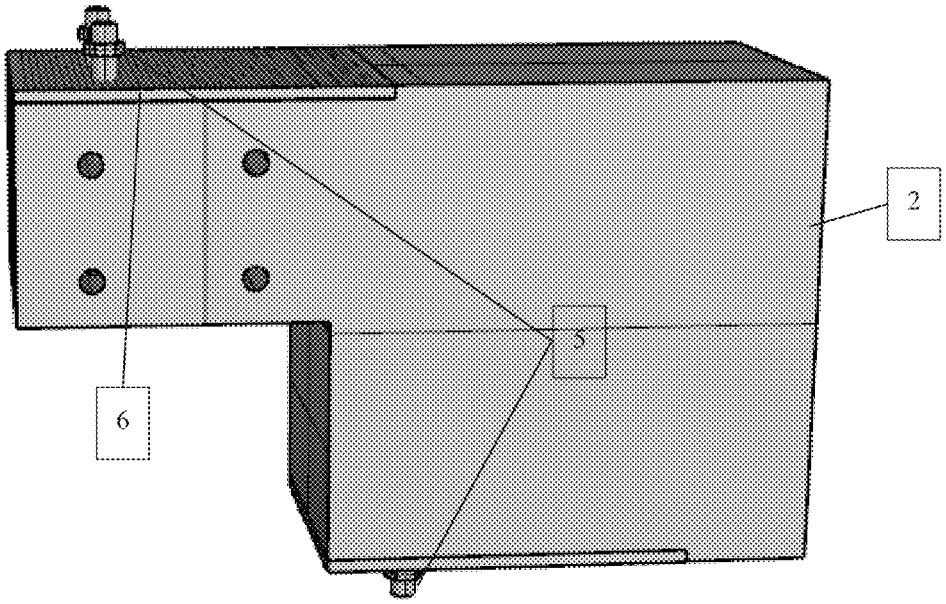
FIG. 4 is a stereogram of a prefabricated concrete notch beam of a dry process connected energy-consuming beam column joint provided by an embodiment of the present application.

To make clearer the objectives, technical solutions, and advantages of the embodiments of the present invention, the following clearly and completely describes the technical solutions of the present invention with reference to the accompanying drawings in the embodiments of the present invention. Apparently, the described embodiments are some but not all of the embodiments of the present invention. All other embodiments obtained by the person of ordinary skill in the art, based on the embodiments of the present invention without creative work, will fall within the scope of protection of the present invention.

FIGS. 1-4 show a dry process connected energy-consuming beam column joint provided by an embodiment of the present application, comprising high-strength bolts 5 for connection and fastening, prefabricated concrete corbel column 1 for bearing vertical load, prefabricated concrete notch beam 2 for bearing bending moment, connecting steel plate 3 for connecting the transmission power, and friction plate 4 for deformation energy-consuming.

The corbel section of the prefabricated concrete corbel column 1 is stepped, and a notch section of the prefabricated concrete notch beam 2 is matched with the stepped section of the corbel and is in lap joint to the stepped section.

The pre-buried steel plates 6 are arranged on the upper and lower sides of the prefabricated concrete notch beam 2 and prefabricated concrete corbel column 1, connecting with the prefabricated concrete notch beam 2 and the prefabricated concrete corbel column 1 into a whole by using a vertical high-strength bolt 5 pre-buried in the prefabricated concrete notch beam 2 and prefabricated concrete corbel column 1.

In an embodiment of the present application, friction plates 4 are arranged outside the pre-buried steel plates 6, and slight tooth spaces are arranged on the sides, facing the pre-buried steel plates 6, of the friction plates 4, so as to consume energy through friction in case of deformation; in this embodiment, the friction plates 4 are also fixed on the corbel or the prefabricated concrete notch beam 2 through the vertical high-strength bolt 5.

The connecting steel plates 3 are arranged on the left and right sides of the prefabricated concrete notch beam 2 and the lap joint section of the prefabricated concrete corbel column 1, the connecting steel plates 3 are provided with a bolt hole, and the horizontal high-strength bolt 5 runs through the bolt hole and connects the connecting steel plates 3 on both sides of the corbel or the prefabricated concrete notch beam 2.

A certain gap a should exist between the notch beam and the corbel column, so that there is enough stroke for the friction plate to consume energy under the action of earthquake.

Further research and theoretical analysis show that: in case of shear span ratio $\lambda \geq 4$, the failure mode of beam members is bending failure, or ductile failure; in case of shear span ratio $\lambda \leq 2$, the failure mode of beam members is shear failure, or brittle failure; in case of shear span ratio $2<\lambda<4$, the failure mode of beam members is bending shear failure.

The following can be obtained from the balance formula of beam:

$$\zeta = \frac{f_y(A_s - A_s')}{f_c b h_0} \tag{1}$$

$f_y$—design tensile strength of rebar;

$A_s$—section area of tensile rebar;

$A_s'$—section area of compression rebar;

$f_c$—axial compressive design strength of concrete;

b—width of beam section;

$h_0$—effective height of beam section;

In order to meet the requirements of balanced-reinforced beam, i.e., $$\zeta \leq \zeta_b \tag{2}$$

$\zeta_b$ is the height limit of relative compression zone of beam, i.e., $$\frac{f_y(A_s - A_s')}{f_c b h_0 \zeta_b} \leq 1 \tag{3}$$

Given $$k = \frac{f_y(A_s - A_s')}{f_c b h_0 \zeta_b} \tag{4}$$

It can be seen that $k \leq 1$ according to Formulas (3) and (4). Because $k \leq 1$, we can take k=0, 0.1, 0.2, . . . , 1; when the parameters such as axial compressive design strength of different types of beams and tensile design strength of rebar are placed into Formula (4), it can be known that k=0.9 and 1.0 is not proper, so the value range of K is 0-0.8.

Figure 5:
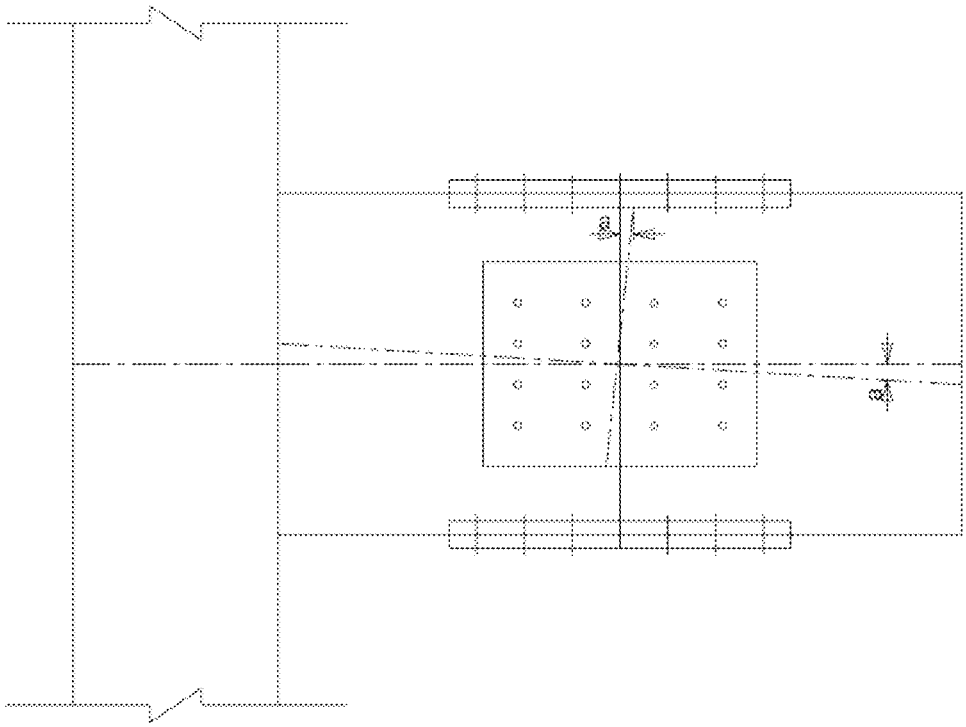
FIG. 5 is a joint rotation diagram of a prefabricated concrete notch beam of a dry process connected energy-consuming beam column joint provided by an embodiment of the present application.

Referring to FIG. 5, the shear deformation angle θ of members is hereby incorporated as a deformation parameter:

The calculation formula of shear deformation angle θ of members is as follows:

$$\theta = \frac{\Delta}{l} \tag{5}$$

Δ—displacement of the top of the member under the action of horizontal load;

l—clear height of the member.

The following can be obtained through geometrical relationship:

$$a = \Delta = l\theta. \tag{6}$$

TABLE 1

Numerical Simulation Calculation of Shear Deformation Angle θ of Members

| k | λ ≥ 4 | λ ≤ 2 | 2 < λ < 4 |
|---|---|---|---|
| 0 | 0.02301 | 0.02257 | 0.02137 |
| 0.1 | 0.02122 | 0.02115 | 0.01979 |
| 0.2 | 0.01951 | 0.01925 | 0.01773 |
| 0.3 | 0.01657 | 0.01753 | 0.01621 |
| 0.4 | 0.01469 | 0.01559 | 0.01436 |
| 0.5 | 0.01233 | 0.01395 | 0.01222 |

TABLE 1-continued

Numerical Simulation Calculation of Shear Deformation Angle θ of Members

| k | λ ≥ 4 | λ ≤ 2 | 2 < λ < 4 |
|---|---|---|---|
| 0.6 | 0.01106 | 0.01267 | 0.01057 |
| 0.7 | 0.00927 | 0.01058 | 0.00916 |
| 0.8 | 0.00625 | 0.00771 | 0.00593 |

Note:

The data from the above table come from the *Analysis of Deformation Limits for Reinforced Concrete Beam* published on the Journal of Shenyang University of Technology (Page 715-720, Issue 6, Vol. 33, 2011; by WAN Haitao and HAN Xiaolei).

A construction method for the dry process connected energy-consuming beam column joint based on a corbel established according to the present application, comprising the following steps:

Determining the size of a friction plate 4 and the thickness of a steel plate according to the design documents.

Determining the quantity and diameter of high-strength bolts according to the design documents.

Hoisting a prefabricated concrete corbel column 1, correcting the plane position and verticality of the prefabricated concrete corbel column 1.

Installing the prefabricated concrete corbel column 1 after meeting the requirements.

Repeating step 2 to complete the installation of all prefabricated concrete corbel columns 1.

Hoisting a prefabricated concrete notch beam 2, and correcting the axis position and elevation of the prefabricated concrete notch beam 2.

Applying the high-strength bolts 5 to install a connecting steel plate 3, connecting the prefabricated concrete notch beam 2 and the prefabricated concrete corbel column 1 into a whole;

Applying the high-strength bolts 5 to install the friction plate 4.

Lastly, it should be noted that the above embodiments are only intended to illustrate the technical solution of the present invention, rather than posing any limitation. Although the present invention is illustrated in detail with reference to the embodiments, the person of ordinary skill in the art can understand that they can still modify the technical solution described in the embodiments, or equally replace some technical features therein, and such modification and replacement will not deviate the technical solution from the spirit and scope of the technical solution of embodiments in the present invention.

What is claimed is:

1. A construction method for a dry process connected energy-consuming beam column joint based on a corbel, the beam column joint comprises:

a prefabricated concrete corbel column, wherein a corbel section of the prefabricated concrete corbel column is stepped, and a notch section of a prefabricated concrete notch beam is matched with a stepped section of the corbel and the notch section of the prefabricated concrete notch beam is in a lap joint to the stepped section;

pre-buried steel plates separately pre-buried on upper and lower surfaces of the corbel and the prefabricated concrete notch beam, wherein friction plates are arranged outside the pre-buried steel plates;

connecting steel plates, wherein the connecting steel plates are arranged on left and right sides of the prefabricated concrete notch beam and a corbel lap joint section;

high-strength bolts, wherein a vertical high-strength bolt runs through the friction plates and the pre-buried steel plates and fixes the friction plates and the pre-buried steel plates on the corbel/the prefabricated concrete notch beam; a horizontal high-strength bolt runs through the corbel/the prefabricated concrete notch beam, and the horizontal high-strength bolt connects the connecting steel plates on both sides;

this construction method comprises the following steps:

a) determining a size of each friction plate of the friction plates, a thickness of each connecting steel plate of the connecting steel plates, a quantity and a diameter of the vertical high-strength bolt, and a quantity and a diameter of the horizontal high-strength bolt according to design documents;

b) prefabricating the prefabricated concrete corbel column and the prefabricated concrete notch beam respectively, pre-burying the pre-buried steel plates, snapping an installation positioning line on two members, indicating a direction, an axis number and an elevation, wherein a first-layer column is marked ±0.00 mm horizontal line;

c) hoisting the prefabricated concrete corbel column, correcting a plane position and a verticality of the prefabricated concrete corbel column, and installing the prefabricated concrete corbel column after meeting requirements;

d) hoisting the prefabricated concrete notch beam, and correcting an axis position and an elevation of the prefabricated concrete notch beam;

e) applying the horizontal high-strength bolt to install the connecting steel plates, connecting the prefabricated concrete notch beam and the prefabricated concrete corbel column into a whole;

f) applying the vertical high-strength bolt to install the friction plates.

2. The construction method for the dry process connected energy-consuming beam column joint based on the corbel according to claim 1, wherein the upper and lower surfaces have one friction plate of the friction plates respectively.

3. The construction method for the dry process connected energy-consuming beam column joint based on the corbel according to claim 1, wherein a predetermined gap a exists between the prefabricated concrete notch beam and the prefabricated concrete corbel column to provide a stroke for each friction plate of the friction plates to consume energy under an action of an earthquake; according to a geometrical relationship of a joint rotation, the gap a is calculated as follows:

$$\Delta = a;$$

a calculation formula of a shear deformation angle θ of a member is as follows:

$$\theta = \frac{\Delta}{l};$$

Δ—a displacement of a top of the member under an action of a horizontal load;

l+a clear height of the member;

and the following is Obtained through the geometrical relationship:

$$a = \Delta = l\theta.$$

4. The construction method for the dry process connected energy-consuming beam column joint based on the corbel according to claim 1, wherein step c) further comprises:

hoisting the prefabricated concrete corbel column in sequence along a longitudinal axis, wherein a hoisting speed is slow during a hoisting process; suspending a lifting after a lifting rope is tightened, and checking a reliability of a lifting point in time to prevent falling off, wherein in order to avoid swinging back and forth when hoisting in place, a slip rope is tied at a lower part of the prefabricated concrete corbel column, and the hoisting is carried out after all parts are connected reliably and correctly.

5. The construction method for the dry process connected energy-consuming beam column joint based on the corbel according to claim 1, wherein step d) further comprises:

hoisting the prefabricated concrete notch beam, checking an elevation and a position of the corbel again before the hoisting, suspending a lifting after being about 500 mm above a ground in a hosting process, checking a hoisting appliance carefully and hosting in place after confirming the hoisting appliance is correct, aligning a positioning line on the prefabricated concrete notch beam with a positioning line on the corbel, placing on the prefabricated concrete corbel column, and making an adjustment, wherein an operator holds from both ends, visually aligns an axis, and drops a hook for the prefabricated concrete notch beam to be seated.

* * * * *